US010586641B2

(12) United States Patent
Good

(10) Patent No.: US 10,586,641 B2
(45) Date of Patent: Mar. 10, 2020

(54) MAGNETIC CLOSURE

(71) Applicant: Max-Planck-Gesellschaft zur Foerderung der Wissenschaften e.V., Munich (DE)

(72) Inventor: Garrett Hayes Good, Goettingen (DE)

(73) Assignee: Max-Planck-Gesellschaft zur Foerderung der Wissenschaften e.V., Munich (DE)

( * ) Notice: Subject to any disclaimer, the term of this patent is extended or adjusted under 35 U.S.C. 154(b) by 163 days.

(21) Appl. No.: 15/245,483

(22) Filed: Aug. 24, 2016

(65) Prior Publication Data

US 2017/0062109 A1 Mar. 2, 2017

(30) Foreign Application Priority Data

Aug. 31, 2015 (EP) ..... 15183182

(51) Int. Cl.

| | |
|---|---|
| ***H01F 7/02*** | (2006.01) |
| ***B65D 33/24*** | (2006.01) |
| ***A41F 1/00*** | (2006.01) |

(52) U.S. Cl.

CPC ..... *H01F 7/0263* (2013.01); *A41F 1/002* (2013.01); *B65D 33/24* (2013.01); *H01F 7/0221* (2013.01); *A44D 2203/00* (2013.01)

(58) Field of Classification Search

CPC ..... B65D 33/24; A41F 1/002; A44D 2203/00
See application file for complete search history.

(56) References Cited

U.S. PATENT DOCUMENTS

| | | | | |
|---|---|---|---|---|
| 2,807,841 | A | 10/1957 | Janos et al. | |
| 3,161,932 | A * | 12/1964 | Seymour | A41F 1/002 24/303 |
| 3,633,393 | A | 1/1972 | Hideyoshi et al. | |
| 4,399,595 | A | 8/1983 | Yoon et al. | |
| 5,604,960 | A * | 2/1997 | Good | A41F 1/002 24/303 |
| 7,187,261 | B2 * | 3/2007 | Cassar | B23Q 3/1546 335/303 |
| 8,373,526 | B2 * | 2/2013 | Fullerton | G01D 18/00 335/285 |

(Continued)

FOREIGN PATENT DOCUMENTS

| | | |
|---|---|---|
| DE | 10 2010 020 456 A1 | 9/2011 |
| WO | WO2013045390 A1 | 4/2013 |

*Primary Examiner* — Robert Sandy
*Assistant Examiner* — Rowland Do
(74) *Attorney, Agent, or Firm* — Thomas | Horstemeyer, LLP

(57) ABSTRACT

A magnetic closure device has two complementary magnetic closure elements. Each of the two complementary magnetic closure elements includes an elongated magnet carrier having a single direction of main extension, and a plurality of permanent magnets supported by the magnet carrier in defined positions along the direction of main extension. Each of the permanent magnets is permanently magnetized either longitudinally or diametrically with regard to the direction of main extension. The permanent magnets following to each other in the direction of main extension are arranged in a closure alignment pattern having a magnetic non-repetition length extending over three or more of the permanent magnets. The magnet carrier is bendable in at least one direction orthogonal to the direction of main extension.

5 Claims, 6 Drawing Sheets

(56) References Cited

U.S. PATENT DOCUMENTS

| | | | | |
|---|---|---|---|---|
| 8,395,467 | B2 * | 3/2013 | Fullerton | G01D 18/00 335/285 |
| 9,330,825 | B2 * | 5/2016 | Sarai | H01F 7/02 |
| 10,098,422 | B2 * | 10/2018 | Fiedler | A44C 5/0007 |
| 2005/0102802 | A1 * | 5/2005 | Sitbon | A41F 1/002 24/303 |
| 2008/0184737 | A1 * | 8/2008 | Wiseman | A44C 11/002 63/3.1 |
| 2008/0256979 | A1 * | 10/2008 | Okamura | A44C 5/2071 63/3.1 |
| 2009/0289090 | A1 * | 11/2009 | Fullerton | A45F 5/02 224/183 |
| 2011/0063061 | A1 * | 3/2011 | Fullerton | G09F 7/04 335/306 |
| 2013/0061431 | A1 * | 3/2013 | Naftali | H01F 7/0215 24/303 |
| 2013/0314184 | A1 * | 11/2013 | Richards | B42F 1/00 335/285 |
| 2014/0000312 | A1 * | 1/2014 | Nicolas | A44C 5/04 63/3.2 |
| 2016/0186789 | A1 * | 6/2016 | Nelson | F16B 1/00 24/303 |

* cited by examiner

↔

MAGNETIC CLOSURE

CROSS REFERENCE TO RELATED APPLICATIONS

This application claims priority to European patent application EP 15 183 182.3 filed on Aug. 31, 2015.

FIELD

The present invention relates to a magnetic closure device comprising two magnetic closure elements.

BACKGROUND

WO 2013/045390 A1 discloses a magnetic zip fastener comprising a pair of magnetic closure elements having an outer casing. Each magnetic closure element comprises an essentially tubular inner cavity for accommodating permanent magnets with essentially circular cross-section, and magnetically inert spacer means. The permanent magnets are adapted to rotate within said cavity with respect to said casing. In a coupling position of the magnetic zip fastener the permanent magnets of one of the magnetic closure elements, by effect of attractive magnetic forces, are substantially taken into contact with the permanent magnets of the other magnetic closure element. The permanent magnets may be magnetic balls so that their magnetization directions may assume any orientation with regard to directions of main extension of the two magnetic closure elements under the influence of magnetic forces, or they may be cylinders permanently magnetized diametrically with regard to the direction of main extension and only rotating about the direction of main extension of the respective magnetic closure element. The magnetic zip fastener may replace a common zipper of a jacket.

If the two magnetic closure elements of the magnetic zip fastener known from WO 2013/045390 A1 are arranged at an offset in their directions of main extension which is more than half of the distance of the permanent magnets, attractive magnetic forces will act between the magnetic closure elements which conserve or even increase the offset and fix the magnetic closure elements at each other at this offset.

U.S. Pat. No. 4,399,595 A discloses a magnetic closure mechanism comprising two strips of flexible, non-magnetic material having permanent magnets incorporated in them. The permanent magnets are permanently magnetized diametrically with regard to the directions of main extension of the two strips. In each of the two strips the permanent magnets are alternately oriented so that neighboring faces of the permanent magnets have opposite magnetic polarity. In a closed position of the magnetic closure mechanism adjacent faces of the permanent magnets embedded in the two strips have opposite magnetic polarities and attract each other. Whereas the permanent magnets in one of the two strips are at fixed positions in the direction of main extension of the strip, the permanent magnets in the other strip are movable along the direction of main extension of the strip. Means for moving these movable permanent magnets may be used for moving them so that adjacent permanent magnets in the two strips have same polarities, thus magnetically pushing the permanent magnets of the two strips away from each other or releasing the first and second strips.

In the magnetic closure mechanism known from U.S. Pat. No. 4,399,595 A, the alignment of the two strips in their directions of main extension is ensured by a mechanical arrangement of a longitudinal extending recess of one strip into which a longitudinally extending protrusion of the other strip only completely engages if the strips are correctly aligned.

U.S. Pat. No. 2,807,841 A discloses a cabinet closure and sealing arrangement. A gasket of this arrangement includes a series of longitudinally magnetized permanent magnets providing attractive magnetic forces pulling the gasket against a metallic wall of the cabinet. The individual elongated magnets are aligned throughout the gasket with successive magnets oriented with opposite polarity so as to have pole faces of like polarity directed towards each other. This causes a repulsion of the magnetic flux which, therefore, in a closed position of a door provided with the gasket, follows a preferential path from each of the magnets to the metallic portion of the cabinet.

U.S. Pat. No. 3,633,393 A discloses a lock comprising rotary tumblers each having a magnet and provided rotatably inside a main body of the lock. The tumblers are permitted to rotate to a given position through operation of magnets incorporated in a key. The lock further comprises a locking or unlocking mechanism operating in relation to said rotary tumblers.

There still is a need of a closure device comprising two magnetic closure elements which only closes, if the two magnetic closures elements are aligned as desired, without the aid of mechanical aligning means, and a magnetic closure element suitable for making such a closure device.

SUMMARY

The present invention provides magnetic closure device comprises two complementary magnetic closure elements. Each of the two complementary magnetic closure elements comprises an elongated magnet carrier having a single direction of main extension, and a plurality of permanent magnets supported by the magnet carrier in defined positions along the direction of main extension. Each of the permanent magnets is permanently magnetized either longitudinally or diametrically with regard to the direction of main extension. The permanent magnets following to each other in the direction of main extension are arranged in a closure alignment pattern having a magnetic non-repetition length extending over three or more of the permanent magnets. The magnet carrier is bendable in at least one direction orthogonal to the direction of main extension.

Further, the invention provides a piece of clothing, like, for example, a jacket, and a flexible container, like, for example, a bag, comprising such a magnetic closure device, wherein the two complementary magnetic closure elements are arranged on opposite sides of an opening of the piece of clothing or flexible container, respectively.

Other features and advantages of the present invention will become apparent to one with skill in the art upon examination of the following drawings and the detailed description. It is intended that all such additional features and advantages be included herein within the scope of the present disclosure, as defined by the claims.

BRIEF DESCRIPTION OF THE DRAWINGS

The present invention can be better understood with reference to the following drawings. The components in the drawings are not necessarily to scale, emphasis instead being placed upon clearly illustrating the principles of the present invention. In the drawings, like reference numerals designate corresponding parts throughout the several views.

DETAILED DESCRIPTION

Figure 1:
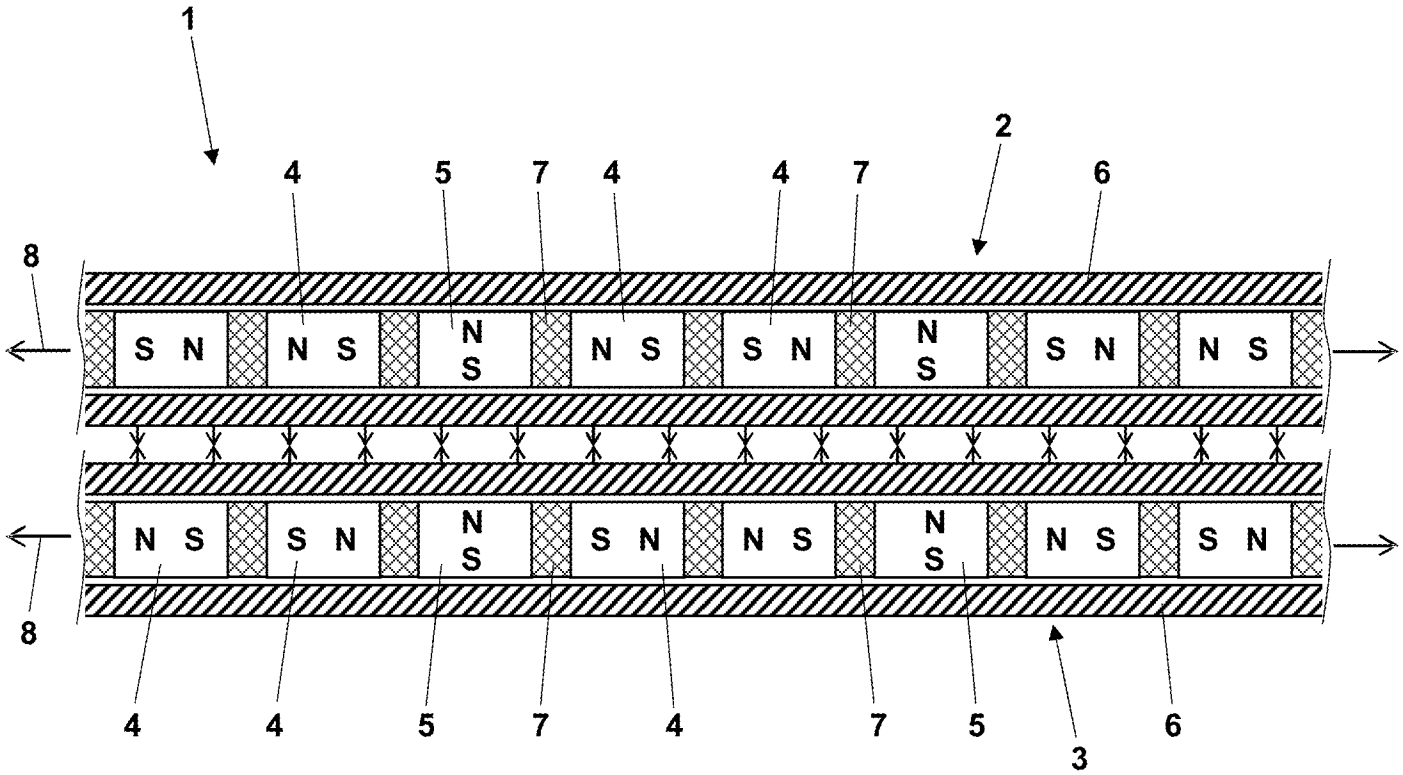
FIG. 1 shows a closure device according to the present invention with two properly aligned complementary magnetic closure elements comprising both longitudinally magnetized and diametrically magnetized permanent magnets.

In a magnetic closure according to the present invention, each of two magnetic closure elements comprises an elongated magnet carrier having a single direction of main extension and a plurality of permanent magnets supported by the magnet carrier in defined positions along the direction of main extension, each permanent magnet being permanently magnetized either longitudinally or diametrically with regard to the direction of main extension. The permanent magnets following to each other in the direction of main extension are arranged in a closure alignment pattern having a magnetic non-repetition length extending over three or more consecutive permanent magnets, and the magnet carrier is bendable in at least one direction orthogonal to the direction of main extension. When combining the two complementary magnetic closure elements, a maximum attractive magnetic force pulling the two complementary magnetic closure elements towards each other is only achieved with a proper alignment of the two complementary magnetic closure elements in their directions of main extension. A comparably strong attractive magnetic force pulling the two complementary magnetic closure elements towards each other is only occurring with an obvious strong misalignment of the magnetic closure elements by three or more consecutive permanent magnets. The magnetic non-repetition length is a contains a non-repeating sequence of polarities and distances of the magnetic north and south poles of the individual permanent magnets along the direction of main extension. In other words, the closure alignment pattern shows no identical repetition of any magnetic subpattern which does not extend over at least consecutive permanent magnets The magnetic non-repetition length of the permanent magnets in the gasket according to U.S. Pat. No. 2,807,841 A, for example, extends over two consecutive permanent magnets only, as every third permanent magnet has a corresponding magnetization direction and position as compared to the first permanent magnet in the row. In the magnetic closure element according to the present invention, the magnetic non-repetition length is preferably at least twice as high, i.e. extending over at least four consecutive permanent magnets.

In the magnetic closure element, the permanent magnets are in defined positions along the direction of main extension. This does not exclude that the permanent magnets may move in the direction of main extension over small distances as compared to their lengths in the direction of main extension. Essentially, the positions of the magnet carriers along the direction of main extension are fixed with regard to the magnet carrier.

Further, in the magnetic closure element, the permanent magnets may rotate about the direction of main extension of the magnet carrier. Such a rotation does not change the magnetization of the permanent magnets between a longitudinal and a diametrical magnetization, i.e. between a magnetization direction in line with or orthogonal to the direction of main extension of the magnet carrier. Each of the permanent magnets is permanently magnetized either longitudinally or diametrically with regard to the direction of main extension, and it does neither change its magnetization direction nor its orientation with regard to the magnet carrier resulting in a change between longitudinal and diametrical magnetization.

The magnetic closure element is able to automatically form a full closure with a complementary magnetic closure element upon a single point of contact initiated by the user, by the subsequent attraction of neighboring magnets. The closure alignment pattern, by means of magnetic forces, ensures that the magnetic closure element is only attracted to make the full closure with the complementary magnetic closure element if the point of contact is consistent with a correct alignment of the two closure elements in their directions of main extension. For providing a closure alignment pattern having a magnetic non-repetition length extending over three or more consecutive permanent magnets, the closure alignment pattern may comprises at least one of (a) t different lengths of and/or different distances between the permanent magnets resulting in different intervals of magnetic poles on the permanent magnets in the direction of main extension, and (b) both longitudinally magnetized permanent magnets and diametrically magnetized permanent magnets. The different lengths or distance and the different kinds of longitudinal and diametrical polarization of the permanent magnets allow for coding a closure alignment pattern which only provides a maximum attractive magnetic force between two complementary magnetic closure elements, if the closure elements are perfectly aligned. Without this alignment, there will be at least areas in which repulsive forces push the complementary magnetic closure elements away from each other. Preferably, there will only be few areas in which the complementary magnetic closure elements attract each other, if they are not correctly aligned. If contact is initiated at a point inconsistent with a proper alignment, an automatic closure will be unsuccessful within the magnetic non-repetition length of the closure alignment pattern due to a lack of attractive forces (or even repulsive forces), thereby preventing a closure not correctly and intentionally initiated by the user.

Different lengths of the permanent magnets will have a maximum coding effect on the closure alignment pattern, if distances between neighboring permanent magnets are all the same or vary in a same sense. Vice versa, different distances between the permanent magnets have a maximum coding effect, if the lengths of the permanent magnets are the same or vary in a same sense. Only a little coding effect is achieved, if the different lengths of the permanent magnets are compensated for by different distances so that the centers of the permanent magnets are, for example, arranged at constant intervals along the magnet carrier.

In a similar way, a combination of longitudinally and diametrically magnetized permanent magnets should be designed such as to achieve a maximum closure alignment effect, i.e. a maximum attractive magnetic force with aligned complementary magnetic closure elements and an as little attractive magnetic force as possible or even a magnetic repulsive force with not correctly aligned complementary closure elements.

The non-repetition length of the magnetic closure element may cover the entire magnetic closure element. Depending on its actual use, the non-repetition length of the closure alignment pattern may, however, also be just a fraction of the overall length of the magnetic closure element. In absolute terms, the non-repetition length of the closure alignment pattern in the direction of main extension may be at least 4 cm, preferably at least 6 cm, more preferably at least 8 cm, even more preferably at least 10 cm and most preferably at least 12 cm.

If an average distance between neighboring permanent magnet in the closure alignment pattern is not more than 50%, preferable not more than 40%, more preferably not more than 30%, even more preferably not more than 20% and most preferably not more than 10% of an average length of the permanent magnets in the direction of main extension, the density of the permanent magnets along the magnetic closure element and the resulting maximum attractive magnetic force with correctly aligned complementary magnetic closure elements are particularly high.

The embodiment of the magnetic closure element with permanent magnets of different lengths may comprise some permanent magnets which are twice as long in the direction of main extension as others of the permanent magnets. Such permanent magnets of double length provide for a strong disturbance of the magnetic order resulting in repulsive magnetic forces with any offset of two complementary magnetic closure elements in their directions of main extension.

In the embodiment of the magnetic closure element comprising permanent magnets of different lengths, the permanent magnets in the closure alignment pattern may have more than two different lengths, like for example three, four or five different lengths. The coding strength of the closure alignment pattern, i.e. the difference between the maximum attractive magnetic force with correctly aligned complementary magnetic closure elements and the difference between this maximum attractive magnetic force with regard to all smaller attractive or even repulsive magnetic forces present with not correctly aligned complementary magnetic closure elements may, however, not be enhanced by more than two different lengths of the permanent magnets, thus two lengths of the permanent magnets one length being twice the other length may be most preferred.

With diametrically magnetized permanent magnets the coding effect of the closure alignment pattern may be enhanced in that the magnetized permanent magnets are fixed in rotation direction about the direction of main extension.

The magnet carrier of the magnetic closure element is flexible, i.e. bendable in at least one direction orthogonal to its direction of main extension. Preferably, it is bendable in all directions orthogonal to its direction of main extension.

In a particular embodiment of the magnetic closure element according to the present invention, the magnet carrier comprises a flexible tube enclosing the permanent magnets. The tube, as any magnet carrier in the magnetic closure element, will be made of a non-magnetic material.

In addition to the tube, the magnet carrier may comprise a longitudinal connection flange attached to the tube. This connection flange may be used to attach the flexible tube and thus the magnetic closure element to a rim of a closure to be closed by means of the magnetic closure element and a complementary magnetic closure element.

Further, the flexible tube may have an inner diameter which is greater than an outer diameter of the permanent magnet. In this case, the bendability of the tube is as little affected as possible by the permanent magnets arranged within the tube. Neighboring permanent magnets will keep themselves at a distance, if they are longitudinally magnetized and if they are facing each other along the direction of main extension with magnetic poles of same polarities. Then, restricting an overall length of the area over which the permanent magnets may be arranged within the tube may be sufficient to define the longitudinal position of each permanent magnet along the magnetic closure element. However, additional non-magnetic spacer elements may be arranged between the permanent magnets to keep them at defined distances.

As already indicated above, the magnetization directions of neighboring longitudinally magnetized permanent magnets should be opposite to each other, resulting in a magnetic repulsive force between them and in dense magnetic field lines extending perpendicular to the direction of main extension. With same magnetization directions of neighboring longitudinally magnetized permanent magnets, the magnetic field lines will essentially only run between the facing end faces of the neighboring permanent magnets. With neighboring diametrically magnetized permanent magnets magnetic forces stabilizing the arrangement will occur without most of the magnetic field lines only running between the facing end faces of the neighboring permanent magnets.

On the other hand, two longitudinally or diametrically magnetized permanent magnets may be attached to each other with same magnetization directions to provide one permanent magnet of double length. Consequently, two or more neighboring longitudinally or diametrically magnetized permanent magnets comprising same magnetization directions are regarded as one longitudinally or diametrically magnetized permanent magnet here. Thus, the permanent magnets of the magnetic closure element may all consist of identical magnetic units, if either all permanent magnets of the magnetic closure element are longitudinally magnetized or all permanent magnets of the magnetic closure element are diametrically magnetized. All permanent magnets of the magnetic closure element being longitudinally magnetized or all permanent magnets of the magnetic closure element being diametrically magnetized may also be a feature of the magnetic closure element, if its permanent magnets are not all made of same magnetic units.

Particularly, the permanent magnets may be elongated cylinders or elongated boxes of square cross-section.

The closure device according to the present invention comprises two complementary magnetic closure elements, wherein the closure alignment patterns of the two complementary closure elements magnetically correspond to each other in such a way that a magnetic north pole of each of the permanent magnets in the one magnetic closure element is facing a magnetic south pole of one of the permanent magnets in the other of the magnetic closure elements, if the closure elements are aligned in their direction of main extension. With diametrically magnetized permanent magnets, the two complementary closure elements may in fact be identical, even if the diametrically magnetized permanent magnets have fixed magnetization directions with regard to the magnet carrier. With such diametrically magnetized permanent magnets of fixed magnetization direction, the magnetic forces between the complementary closure elements will not only code an alignment in the directions of main extension of the closure elements but also in rotation direction around these directions of main extension.

The elongated magnets carriers of the two complementary closure elements may also comprise complementary surface contours fitting into each other orthogonally to their directions of main extensions if the two complementary closure elements are both aligned in their directions of main extension and in rotation directions around their directions of main extension.

The closure device may be implemented in a piece of clothing. For example, the piece of clothing may be a jacket comprising the two complementary magnetic closure elements of the closure device on both sides of its main opening.

The closure device may also be implemented in containers, preferably flexible containers. For example, the flexible container may be a bag comprising the two complementary magnetic closure elements of the closure device on both sides of its main opening.

Referring now in greater detail to the drawings, the closure device 1 depicted in FIG. 1 comprises two complementary magnetic closure elements 2 and 3. The magnetic closure elements 2 and 3 each include a plurality of permanent magnets 4 and 5 within a tubular magnet carrier 6 made of a non-magnetic material. Between each pair of neighboring permanent magnets 4, 5 an non-magnetic spacer 7 is arranged within the respective magnet carrier 6 defining a certain distance between the permanent magnets 4 and 5. Due to the spacers 7, each of the permanent magnets 4, 5 has a defined position along the respective magnet carrier 6. The magnet carrier 6 may be provided with an attachment flange, not depicted here, for attaching the closure elements to the rims of a closeable main opening of a jacket or bag, for example.

The permanent magnets 4 are longitudinally magnetized with regard to a direction of main extension 8 of the respective magnet carrier 6. The actual magnetization directions of the longitudinally magnetized permanent magnets differ. Here, there are pairs of directly neighboring longitudinally magnetized magnets 4 with opposite magnetization directions, and these opposite magnetization directions vary from inwardly to outwardly between two of these pairs following to each other in the direction of main extension 8 of the respective magnet carrier 6. Further, one diametrically magnetized magnet 5 is arranged between any pair of two oppositely longitudinally magnetized magnets 4. All permanent magnets 4 and 5 have a same length in the directions of main extension 8. When the magnetic closure elements 2 and 3 are correctly aligned according to FIG. 1, magnetic poles of opposite polarity face each other over the distance between the magnetic closure elements 2 and 3, resulting in attractive magnetic forces indicated by arrows pointing towards each other. As the permanent magnets 4, 5 are arranged at a high density along the directions of main extension 8, the magnetic forces holding the two properly aligned closure elements 2 and 3 together are high as compared to a magnetic strength of the individual permanent magnets 4 and 5.

Figure 2:
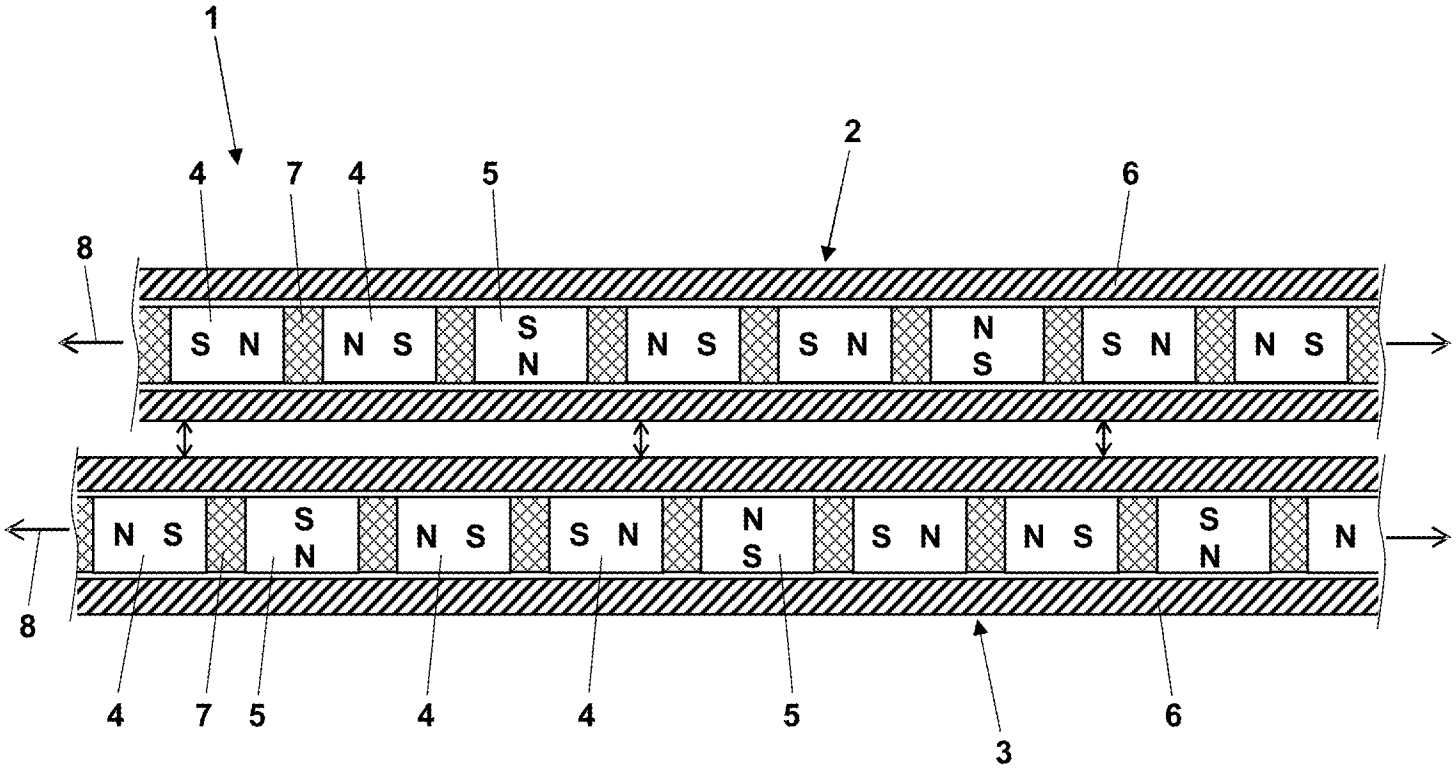
FIG. 2 shows the closure device according to FIG. 1 with a misalignment of the two complementary magnetic closure elements in a first variant.

The permanent magnets 4 and 5 may, for example, be elongated cylinders with a slightly smaller outer diameter than an inner diameter of the tubular magnet carriers 6. The same may apply to the spacers 7 so that the permanent magnets 4, 5 and the spacers 7 do not inhibit bending the flexible magnet carriers 6. If this difference in diameters allows for rotation of the permanent magnets 4, 5 within the magnet carriers 6 and thus for rotation of the magnetization directions of the diametrically magnetized permanent magnets 5 about the directions of main extension 8, there may be certain misalignments between the complementary magnetic closure elements 2 and 3 in which quite high attractive magnetic forces are present between the complementary magnetic closure elements 2 and 3. Such a misalignment is depicted in FIG. 2. Here, the upper left permanent magnet 5 of the magnetic closure element 2 and the lower center permanent magnet 5 of the complementary closure element have rotated and thus changed their diametrical magnetization directions as compared to FIG. 1. As a consequence, there are only few magnetic poles of same polarity facing each other over the distance between the complementary magnetic closure elements 2 and 3 and thus resulting in repulsive magnetic forces indicated by double-headed arrows in FIG. 2.

Figure 3:
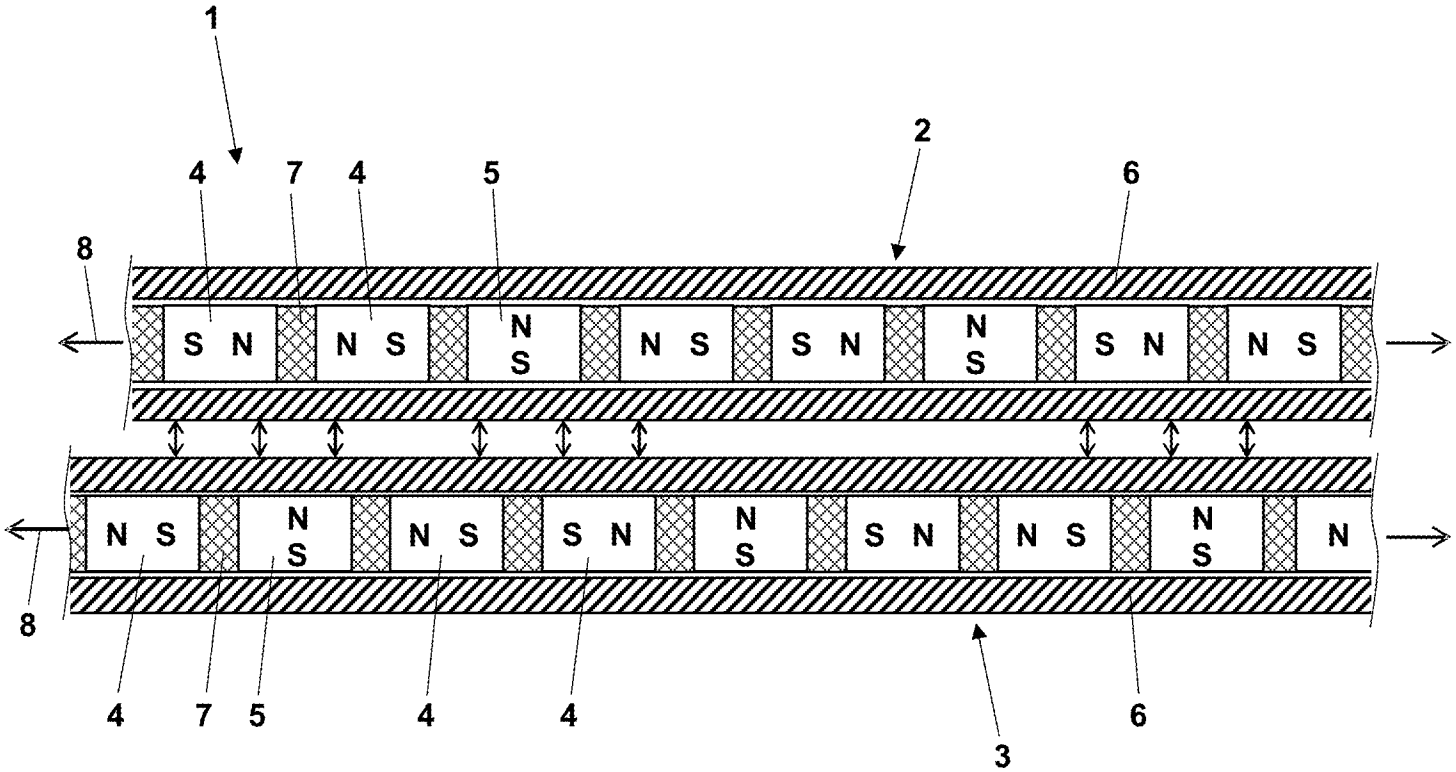
FIG. 3 shows the closure element according to FIG. 1 with the same misalignment as in FIG. 2 in another variant.

FIG. 3 shows the same misalignment between the complementary magnetic closure elements 2 and 3 as in FIG. 2 but with permanent magnets 5 whose diametrical magnetization direction is fixed, i.e. not rotating about the directions of main extension 8 of the tubular magnet carriers 6. As a consequence, all the permanent magnets 4 and 5 have the same magnetization directions, and there are some more pairs of magnetic poles of same polarity facing each other over the distance between the complementary magnetic closure elements 2 and 3 and resulting in repulsive magnetic forces.

The sequences of the polarities of the magnetic poles of the two complementary magnetic closure elements 2 and 3 according to FIGS. 1 and 3 are principally identical. In the alignment of FIG. 1, these sequences are offset by three permanent magnets 4, 5. A magnetic non-repetition length of the sequences according to FIGS. 1 to 3 extends over six permanent magnets 4, 5, i.e. only every seventh permanent magnet 4, 5 has a corresponding magnetization direction and position with regard to its neighboring permanent magnets as the first one of the respective sequence.

Figure 4:
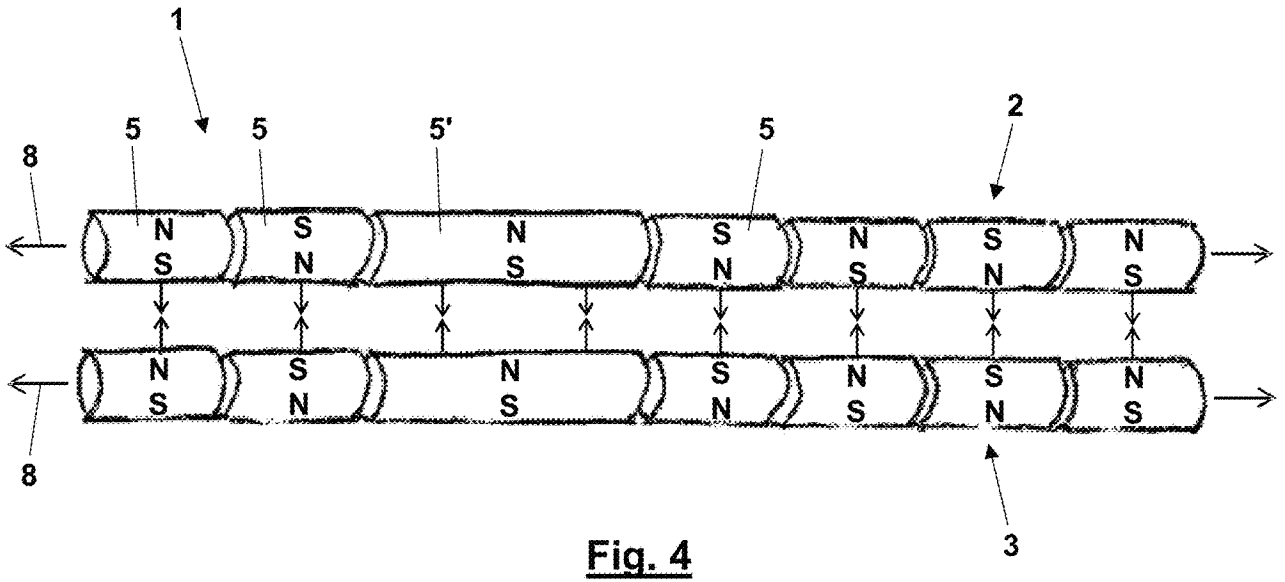
FIG. 4 shows the arrangement of the permanent magnets of the two complementary magnetic closure elements of another embodiment of the closure device than in FIGS. 1 to 3 with properly aligned closure elements comprising diametrically magnetized permanent magnets of two different lengths.

In the embodiment of the closure device 1 depicted in FIG. 4 without showing the magnet carriers 6, all permanent magnets of the two complementary magnetic closure elements 2 and 3 are diametrically magnetized permanent magnets 5, 5' of fixed, i.e. non-rotating magnetization direction with regard to the respective directions of main extension 8. Here, the diametrically magnetized permanent magnets 5 and 5' are of different lengths, the permanent magnets 5' being twice as long as the permanent magnets 5 in the respective direction of main extension 8. The fixed magnetization directions of all permanent magnets 5, 5' are opposite with each pair of directly neighboring permanent magnets 5 and 5'. With the correctly aligned complementary magnetic closure elements 2 and 3, the permanent magnets 5' of double length are facing each other, and maximum attractive magnetic forces are present between the two magnetic closure elements 2 and 3.

Figure 5:
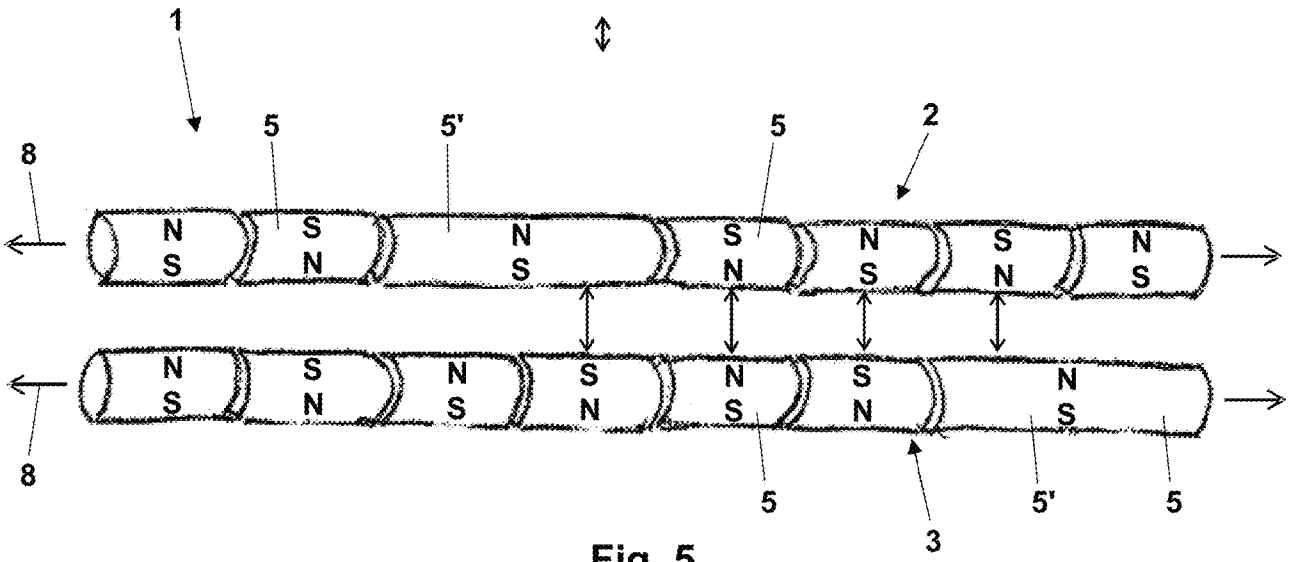
FIG. 5 shows the closure device of FIG. 4 with a misalignment of its two complementary magnetic closure elements.

In case of a misalignment as depicted in FIG. 5, repulsive magnetic forces occur over the offset between the two permanent magnets 5' of double length within the misalignment. With only one permanent magnet 5' of double length per magnetic closure element 2, 3 the magnetic non-repetition length of the permanent magnets 5, 5' is indefinitely long. The repulsive forces in case of a mismatch will, however, only occur over the offset between the permanent magnets 5' of double length in the complementary magnetic closure elements 2 and 3. Thus, it may be suitable to restrict the non-repetition length by entering additional magnets 5' of double length to increase the repulsive forces in case of a mismatch.

Figure 6:
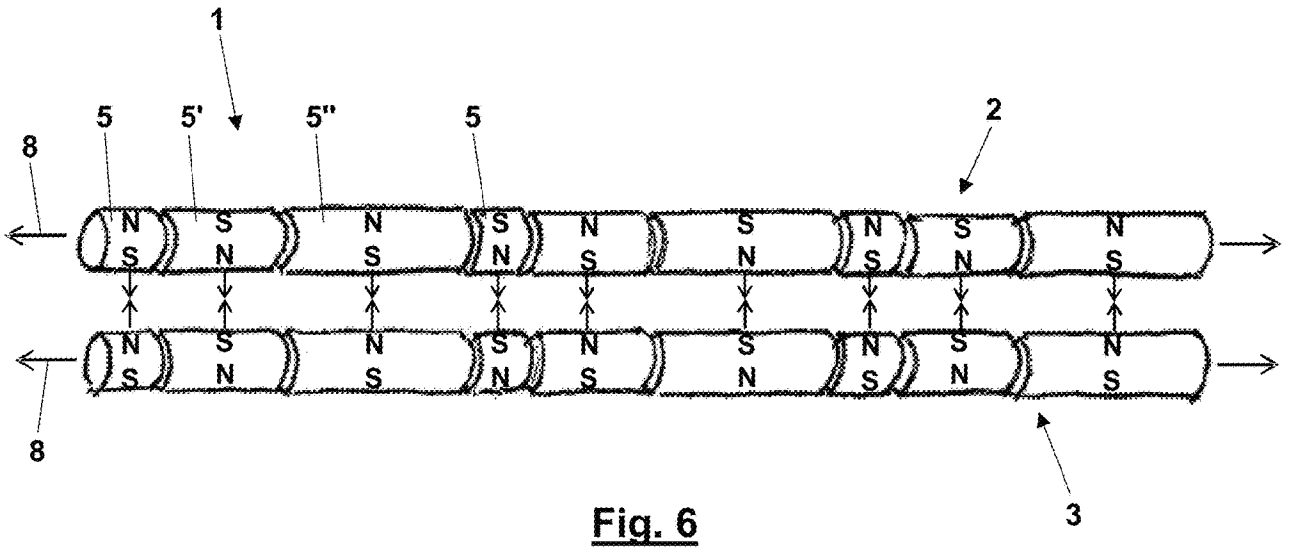
FIG. 6 shows a further embodiment of the closure device with properly aligned complementary magnetic closure elements comprising diametrically magnetized permanent magnets of three different lengths.

FIG. 6 shows an embodiment of the closure device 1 with diametrically magnetized permanent magnets 5, 5' and 5". The permanent magnets 5' are twice as long in the respective direction of main extension 8 as the permanent magnets 5, and the permanent magnets 5" are twice as long as the permanent magnets 5. In the same way as in FIGS. 4 and 5, the diametric magnetization orientations are opposite between neighboring permanent magnets 5, 5', 5". Already with a small misalignment as depicted in FIG. 7, there are some combinations of magnetic poles of same polarities across the distance of the two magnetic closure elements 2 and 3 resulting in repulsive forces.

Figure 7:
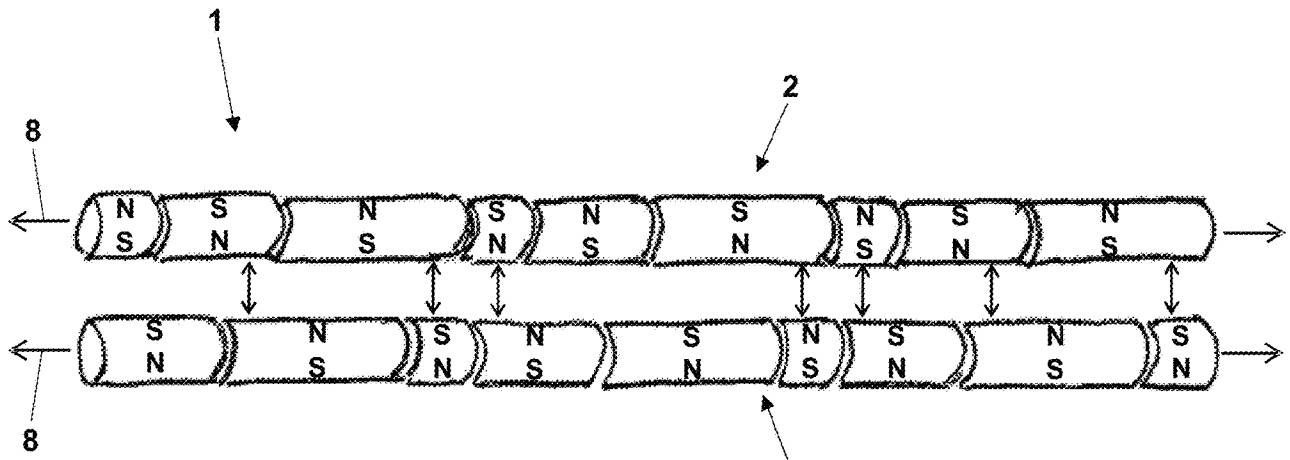
FIG. 7 shows the embodiment of the closure device according to FIG. 6 with a misalignment of the two complementary magnetic closure elements.

The non-repetition length of the permanent magnets 5, 5', 5" of the magnetic closure elements 2 and 3 of FIGS. 6 and 7 extends over six permanent magnets directly following each other in the respective direction of main extension 8.

In the embodiments of the closure device 1 according to FIGS. 4 to 7, no non-magnetic spacers 7 are present.

Figure 8:
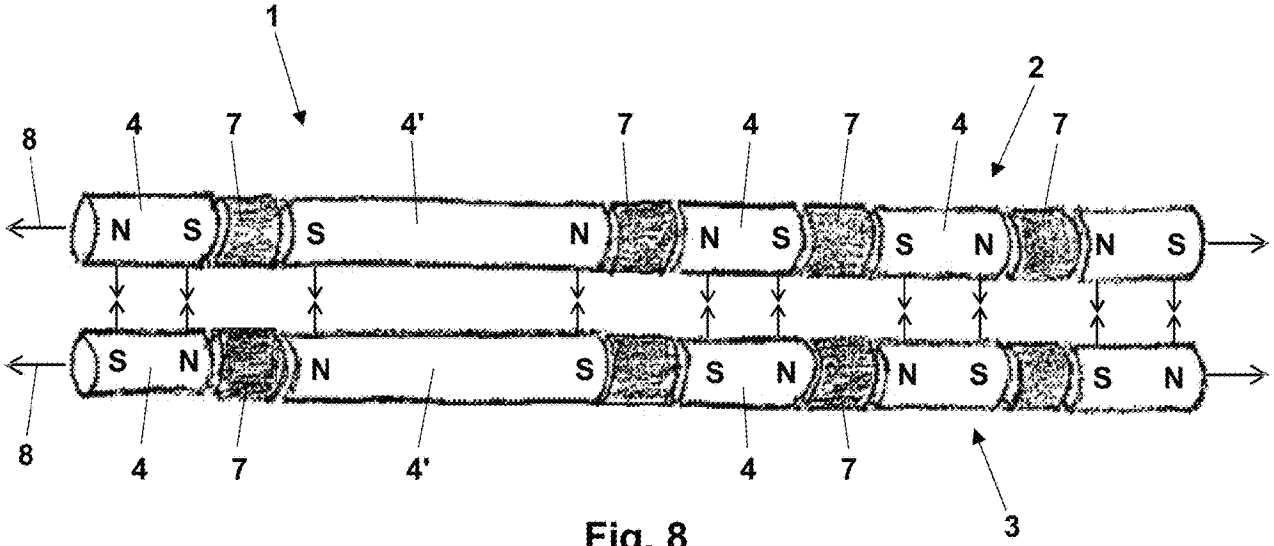
FIG. 8 shows an even further embodiment of the closure device with properly aligned complementary magnetic closure elements comprising longitudinally magnetized permanent magnets of two different lengths.
Figure 9:
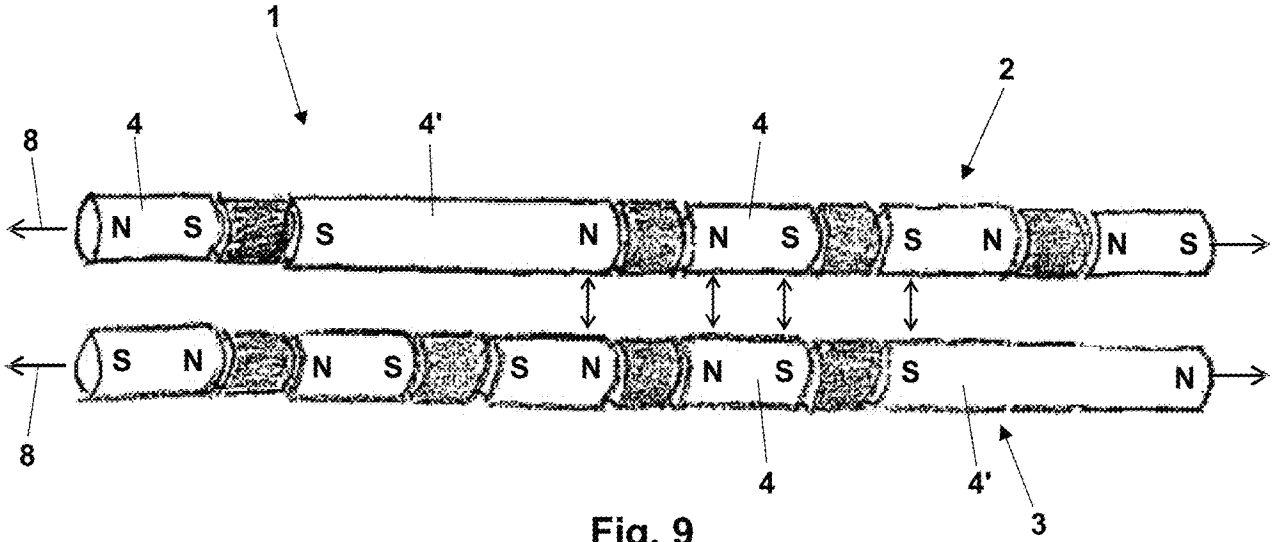
FIG. 9 shows the closure device according to FIG. 8 with a misalignment of the two complementary magnetic closure elements.

In the embodiment of the closure device 1 according to FIG. 8, all permanent magnets 4, 4' of the complementary magnetic closure elements 2 and 3 are longitudinally magnetized. Here, the permanent magnets 4' are as long as two neighboring permanent magnets 4 plus the spacers 7 arranged between them. The longitudinal magnetization directions of directly neighboring permanent magnets 4 and 4' are opposite to each other. With the misalignment depicted in FIG. 9 this results in repulsive magnetic forces over the offset between the permanent magnets 4' of increased length in a similar way as with the misalignment depicted in FIG. 5.

It is also possible to vary the length of the spacers 7 in the directions of main extension 8 to increase the magnetic non-repetition length of the arrangement of the permanent magnets along the directions of main extension 8 in the complementary magnetic closure elements 2 and 3. This, would, however reduce the density of the permanent magnets 4 along the complementary magnetic closure elements 2 and 3.

Many variations and modifications may be made to the preferred embodiments of this disclosure without departing substantially from the spirit and principles of this disclosure. All such modifications and variations are intended to be included herein within the scope of the present disclosure, as defined by the following claims.

The invention claimed is:

1. A magnetic closure device comprises two complementary magnetic closure elements, each of the two complementary magnetic closure elements comprising an elongated magnet carrier having a single direction of main extension, and a plurality of permanent magnets supported by the magnet carrier in defined positions along the direction of main extension, a plurality of the permanent magnets being longitudinally magnetized permanent magnets with regard to the direction of main extension, at least two of the longitudinally magnetized permanent magnets having different lengths, wherein the permanent magnets following each other in the direction of main extension are arranged in a closure alignment pattern having a magnetic non-repetition length extending over three or more of the permanent magnets, the closure pattern including at least two neighboring longitudinally magnetized permanent magnets, wherein the magnet carrier is bendable in at least one direction orthogonal to the direction of main extension, and wherein the magnetization directions of the neighboring longitudinally magnetized permanent magnets are opposite to each other.

2. The magnetic closure device of claim 1, wherein the closure alignment pattern comprises different distances between, the permanent magnets resulting in different intervals of magnetic poles of the permanent magnets in the direction of main extension.

3. The magnetic closure device of claim 1, wherein the magnetic non-repetition length of the closure alignment pattern in the direction of main extension is at least 4 cm, 6 cm, 8 cm, 10 cm or 12 cm.

4. The magnetic closure device of claim 1, wherein all of the permanent magnets are longitudinally magnetized permanent magnets.

5. The magnetic closure device of claim 1, wherein the closure alignment patterns of the two complementary magnetic closure elements magnetically correspond to each other in such a way that a magnetic north pole of each of the permanent magnets in one of the magnetic closure elements is facing a magnetic south pole of one of the permanent magnets in the other of the magnetic closure elements if the complementary closure elements are aligned in their directions of main extension.

* * * * *